US007900290B2

(12) United States Patent
Han

(10) Patent No.: US 7,900,290 B2
(45) Date of Patent: Mar. 8, 2011

(54) DUAL FLUSH REFILL DEVICE

(75) Inventor: Joseph Han, Irvine, CA (US)

(73) Assignee: Fluidmaster, Inc., San Juan Capistrano, CA (US)

( * ) Notice: Subject to any disclaimer, the term of this patent is extended or adjusted under 35 U.S.C. 154(b) by 770 days.

(21) Appl. No.: 11/351,200

(22) Filed: Feb. 9, 2006

(65) Prior Publication Data

US 2006/0174403 A1 Aug. 10, 2006

Related U.S. Application Data

(60) Provisional application No. 60/652,102, filed on Feb. 10, 2005.

(51) Int. Cl.
*E03D 1/14* (2006.01)
*E03D 3/12* (2006.01)

(52) U.S. Cl. ..... 4/325; 4/324; 4/410

(58) Field of Classification Search ..... 4/324, 325, 4/410

See application file for complete search history.

(56) References Cited

U.S. PATENT DOCUMENTS

| | | | | |
|---|---|---|---|---|
| 4,042,982 | A | 8/1977 | Contreras | |
| 4,144,600 | A | 3/1979 | Mayes | |
| 4,189,795 | A | 2/1980 | Conti et al. | |
| 4,497,076 | A * | 2/1985 | Sullivan | 4/392 |
| 5,584,080 | A * | 12/1996 | Nichols-Roy et al. | 4/324 |
| 5,647,068 | A * | 7/1997 | Jensen | 4/325 |
| 6,604,249 | B2 | 8/2003 | Han et al. | |

OTHER PUBLICATIONS

International Search Report and Written Opinion of the International Searching Authority, Aug. 8, 2007.

* cited by examiner

*Primary Examiner* — Tuan N Nguyen
(74) *Attorney, Agent, or Firm* — Gordon & Rees LLP

(57) ABSTRACT

A dual flush refill device refills a bowl of a siphonic toilet with adequate supply of refill water in response to either a full or partial flush without wasting the refill water. The device provides a relatively high flow rate of refill water from a refill tube to an overflow tube in response to a partial flush, and a relatively low rate of refill water from the refill tube to the overflow tube in response to a full flush. As a result, the toilet bowl is refilled with a substantially similar volume of refill water regardless of which flush option is selected.

6 Claims, 6 Drawing Sheets

DUAL FLUSH REFILL DEVICE

RELATED APPLICATIONS

This application relates to, claims priority from, and incorporates herein by reference, as if fully set forth, U.S. Provisional Patent Application Ser. No. 60/652,102 filed on Feb. 10, 2005 and entitled "DUAL REFILL DEVICE".

BACKGROUND OF THE INVENTION

1. Field of the Invention

The present invention relates generally to dual flush systems for toilets and particularly to a refill device for dual flush systems.

2. Description of Prior Art and Related Information

Demand for dual flush toilets continues to grow as a result of concerns over water shortage. Such toilets conserve water by providing the user with options for a partial flush and full flush for liquid and solid wastes, respectively. Dual flush toilets typically deliver lesser or greater amounts of refill water to the bowl as a result of a partial or full flush, respectively, by varying the time during which refill water is directed to the bowl. Thus, less time is provided for flowing refill water to the bowl during a partial flush while more time is provided for a full flush.

In many European countries, a "wash-down" toilet bowl 2 as shown in FIG. 1 is typically employed whereby the force of the water head during a flush pushes the contents in the bowl 2 through a relatively large drain pipe. In such wash-down toilets, only a relatively minor amount of fluid is required to reside in the bowl 2 in a default, rest state so as to block sewage gas from the drain pipe 4 from entering through the bowl into the surrounding atmosphere.

In several non-European countries, such as the U.S., a siphonic toilet is employed. FIG. 2 is a cutaway side view of a typical siphonic toilet 5 as used in the U.S. An inverted U-shaped flow path 7 is disposed between a toilet bowl 9 and an outlet 12, such as a drain pipe. Siphonic toilets 5 require sufficient water in the bowl 9 to fill the inverted flow path so as to induce siphonic action that drains waste in the bowl 9 during a flush cycle. As shown in FIG. 3, siphonic toilets 5 typically leave a very small amount of water 14 in the bowl 9 after a flush cycle. This residual water 14 is insufficient for blocking sewage gas from the outlet 12 and for preparing the bowl 9 for the next flush. Accordingly, the bowls 9 in siphonic toilets 5 need to be refilled with fresh water to a certain level in order to function properly.

The problem with incorporating a dual flush system into a siphonic toilet lies in refilling the bowl to a proper level without wasting water. In a dual flush system, the amount of time provided for refilling the bowl varies with each type of flush. In particular, more time is provided for refilling during a full flush, and less time for a partial flush. Accordingly, if the same volume of refill water is supplied for both types of flushes, then problems arise with either oversupply or undersupply of water due to the differing refill times for partial and full flushes. For example, oversupply occurs when a toilet is set to provide a high flow rate of refill water for a partial flush. Though adequate for the partial flush which has a shorter duration of time for refill, excessive refill water is directed into the bowl and thus wasted during the longer, full flush. Conversely, if a lower flow rate of refill water is delivered for each type of flush, then the bowl will be adequately filled during the longer, full flush. During the partial flush, however, the bowl will be inadequately filled due to the shorter refill time.

Thus, the varying durations of time for refilling the bowl in a dual flush siphonic toilet leads to either water waste or insufficient refilling of the bowl.

SUMMARY OF THE INVENTION

The present invention provides structures and methods which overcome the deficiencies in the prior art.

In particular, structures and methods are provided for varying the refill flow rate, or simply refill rate, for dual flush siphonic toilets. Thus, depending upon the type of flush chosen, the refill rate is controlled to deliver a sufficient amount of refill water to the bowl without oversupplying, or wasting, refill water.

In one aspect, a dual flush refill device is provided for use in connection with a toilet having a toilet bowl, a refill tube, an overflow tube, a partial flush button and a full flush button. The device comprises a slide including a first hole and a second hole. The first hole defines a first area and the second hole defines a second area that is smaller than the first area. At least one actuator causes the first hole to be in fluid communication with the refill tube and the overflow tube when the partial flush button is engaged, and causes the second hole to be in fluid communication with the refill tube and the overflow tube when the full flush button is engaged.

The actuator preferably comprises a first cam coupled to the partial flush button and configured to move the slide a first distance to align the first hole with the refill tube, and a second cam coupled to the full flush button and configured to move the slide a second distance to align the second hole with the refill tube. The device further comprises a button bracket and a refill tube connector coupled to the button bracket and the refill tube. The actuator aligns the first hole with the refill tube connector when the partial flush button is engaged, and aligns the second hole with the refill tube connector when the full flush button is engaged.

In another aspect, a dual flush refill device may comprises a variety of different means for varying the flow rate between the refill tube and the overflow tube in response to either a full flush or partial flush selection by the user. The device is adapted for use in connection with a toilet having a toilet bowl, a refill tube, and an overflow tube, a partial flush button and a full flush button. The device comprises means for providing a first flow rate between the refill tube to the overflow tube in response to the partial flush button being engaged, and means for providing a second flow rate between the refill tube to the overflow tube in response to the full flush button being engaged, with the second flow rate being lesser than the first flow rate.

The device further comprises at least one actuator that activates either the means for providing the first flow rate or the means for providing the second flow rate. The means for providing the first flow rate comprises a first passageway while the means for providing the second flow rate comprises a second passageway. The actuator causes the first passage to be in fluid communication with the refill tube and the overflow tube when the partial flush button is engaged, and causes the second passage to be in fluid communication with the refill tube and the overflow tube when the full flush button is engaged.

The actuator preferably comprises a first cam coupled to the partial flush button and configured to move the slide a first distance to align the first passageway with the refill tube, and a second cam coupled to the full flush button and configured to move the slide a second distance to align the second passageway with the refill tube. The device further comprises a button bracket and a refill tube connector coupled to the button bracket and the refill tube. The actuator aligns the first passageway with the refill tube connector when the partial flush button is engaged, and aligns the second passageway with the refill tube connector when the full flush button is engaged.

The means for providing the first flow rate may also comprise a hole having a full size while the means for providing the second flow rate comprises a slide to partially block the hole.

Alternatively, the means for providing the first flow rate may comprise a large section of a hole defined in a slide while the means for providing the second flow rate comprises a small section of the hole.

A method for refilling a bowl of a dual flush toilet is also provided. The method comprises providing a first flow rate of water from a refill tube to an overflow tube for a first duration of time in response to a partial flush, providing a second flow rate of water from the refill tube to the overflow tube for a second duration of time in response to a full flush, the second flow of water being lesser than the first flow of water, the second duration of time being longer than the first duration of time, and filling the toilet bowl with an equal volume of water from the overflow tube in response to either the partial flush or the full flush.

The step of providing the first flow rate of water from the refill tube to the overflow tube for the first duration of time in response to the partial flush comprises aligning a first hole with a refill tube connector, with the first hole defining a first area. The step of providing the second flow rate of water from the refill tube to the overflow tube for the second duration of time in response to the full flush comprises aligning a second hole with the refill tube connector, with the second hole defining a second area smaller than the first area.

The step of aligning the first hole with the refill tube connector may comprise moving the first hole with a first cam, and the step of aligning the second hole with a refill tube connector comprises moving the second hole with a second cam.

The step of providing the first flow rate of water from the refill tube to the overflow tube for the first duration of time in response to the partial flush may comprise providing fluid communication between the refill tube and the overflow tube with a first passageway. The step of providing the second flow rate of water the refill tube to the overflow tube to the bowl for the second duration of time in response to the full flush may comprise providing fluid communication between the refill tube and the overflow tube with a second passageway. The step of providing fluid communication between the refill tube and the overflow tube with a first passageway comprises positioning the first passageway between the refill tube and the overflow tube while the step of providing fluid communication between the refill tube and the overflow tube with a second passageway comprises positioning the second passageway between the refill tube and the overflow tube.

Alternatively, the step of providing the first flow rate of water from the refill tube to the overflow tube for the first duration of time in response to the partial flush may comprise exposing a hole in fluid communication with the refill tube, while the step of providing the second flow rate of water the refill tube to the overflow tube to the bowl for the second duration of time in response to the full flush comprises partially blocking the hole.

As a further alternative, the step of providing the first flow rate of water from the refill tube to the overflow tube for the first duration of time in response to the partial flush comprises moving a large section of a hole defined in a slide into fluid communication with the refill tube, while the step of providing the second flow rate of water the refill tube to the overflow tube to the bowl for the second duration of time in response to the full flush comprises moving a small section of a hole defined in a slide into fluid communication with the refill tube.

In summary, a dual flush refill device refills a bowl of a siphonic toilet with adequate supply of refill water in response to either a full or partial flush without wasting the refill water. The device provides a relatively high flow rate of refill water from a refill tube to an overflow tube in response to a partial flush, and a relatively low rate of refill water from the refill tube to the overflow tube in response to a full flush. As a result, the toilet bowl is refilled with a substantially similar volume of refill water regardless of which flush option is selected.

The invention, now having been briefly summarized, may be better appreciated by the following detailed description.

DETAILED DESCRIPTION OF THE PREFERRED EMBODIMENTS

The invention and its various embodiments can now be better understood by turning to the following detailed description wherein illustrated embodiments are described. It is to be expressly understood that the illustrated embodiments are set forth as examples and not by way of limitations on the invention as ultimately defined in the claims.

Figure 1:
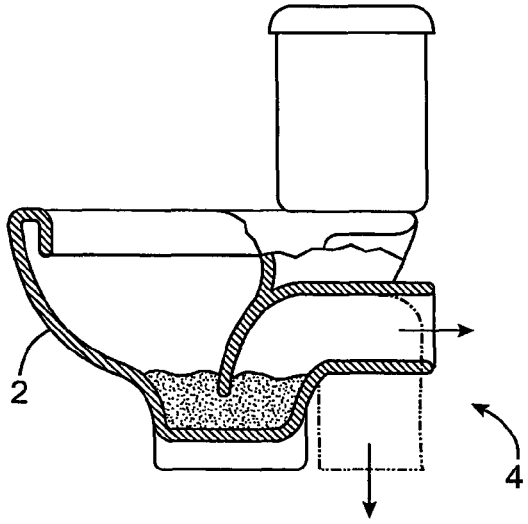
FIG. 1 is cutaway side view of a "wash-down" toilet in the prior art.
Figure 2:
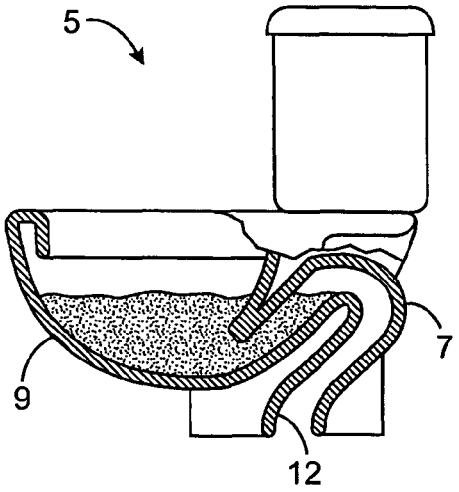
FIG. 2 is a cutaway side view of a siphonic toilet in the prior art showing a water level in a toilet bowl at a rest state.
Figure 3:
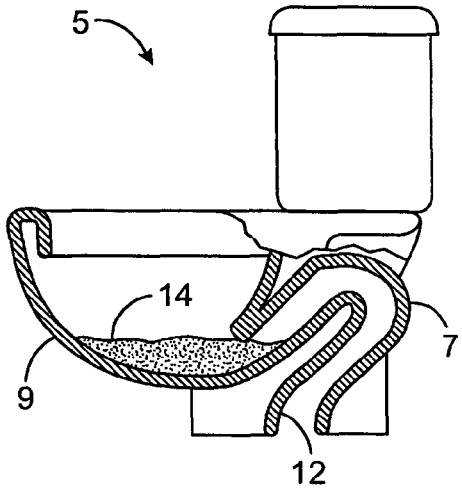
FIG. 3 is a cutaway side view of a siphonic toilet in the prior art showing an insufficient water level in the toilet bowl at a rest state.
Figure 4:
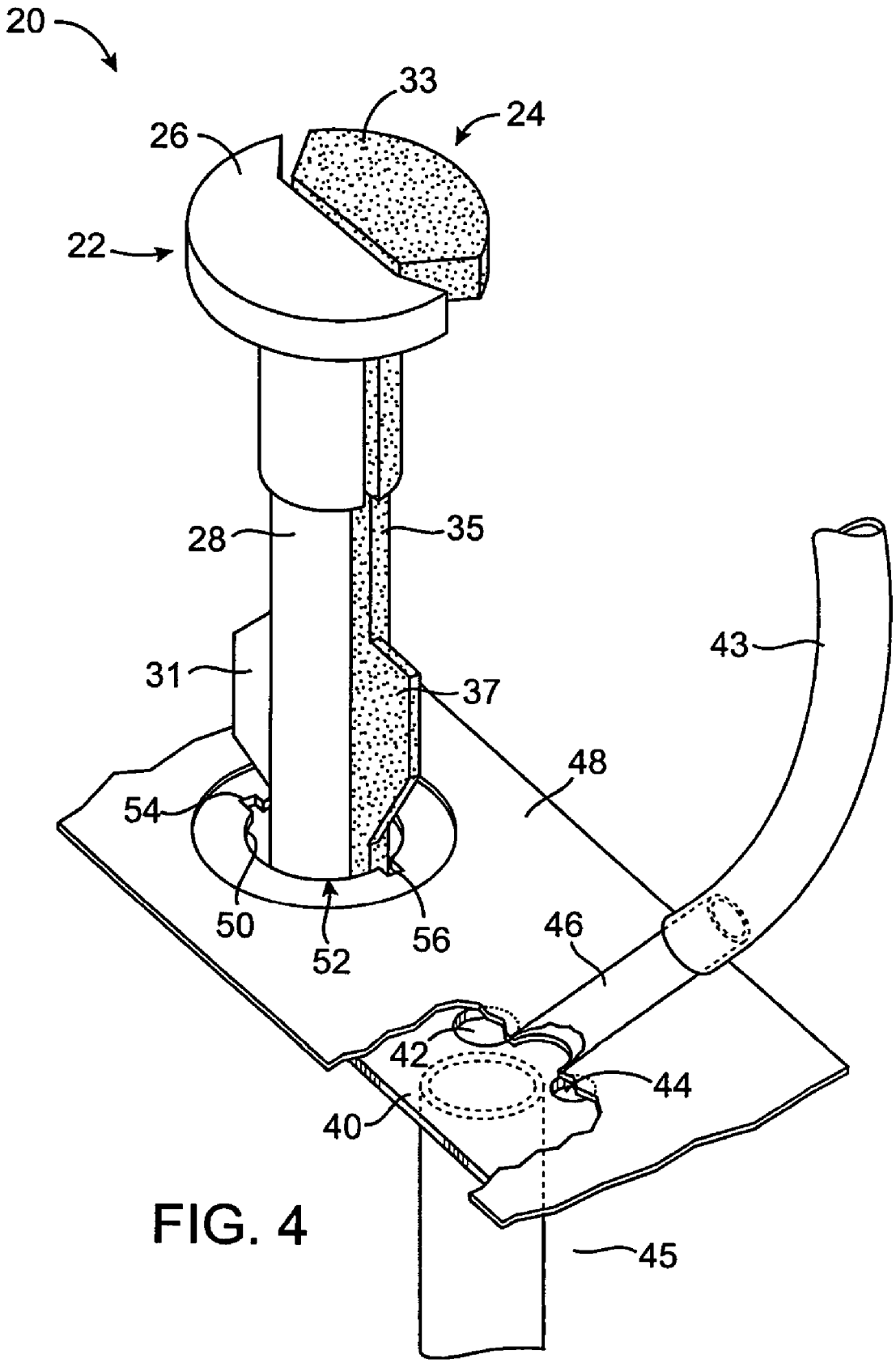
FIG. 4 is a perspective view of a preferred embodiment of a dual flush refill device.

In FIG. 4, a preferred embodiment of a dual flush refill device is illustrated and designated generally by the reference numeral 20. The device 20 is particularly configured for use in connection with siphonic toilets which induce siphonic action to drain waste in the toilet bowl. As described more fully below, the device 20 controls the refill flow rate, or simply refill rate, by providing a high flow rate of refill water in response to a partial flush and a low flow rate of refill water in response to a full flush.

The device 20 comprises a first, full-flush refill mechanism 22 and a second, partial-flush refill button mechanism 24. By varying the flow rate between the two refill mechanisms 22, 24, the device 20 thus refills the toilet bowl of a siphonic toilet to an adequate level for a partial flush and a full flush without oversupplying refill water.

The full-flush refill mechanism 22 comprises a first, full-flush button 26 coupled to a first push rod 28. A first cam 31 is coupled to the first push rod 28. The partial-flush mechanism 24 comprises a second, partial-flush button 33 coupled to a second push rod 35. A second cam 37 is coupled to the second push rod 35.

The device 20 comprises a slide 40 that defines two passageways 42, 44 for providing fluid communication between a refill tube 43 and an overflow tube 45. In particular, a large passageway 42 comprises a relatively large hole 42 that defines a large area for enabling a relatively higher flow rate therethrough. A small passage 44 comprises a relatively small hole 44 defining a small area for enabling a relatively lower flow rate therethrough. A refill tube nipple, or connector, 46 is coupled to a button bracket 48 and adapted to be coupled to the refill tube 43. The tube connector 46 is thus designed to remain stationary while the slide 40 is moved horizontally to align either of the two holes 42, 44 depending upon the type of flush engaged by the user. The slide 40 also defines a slot 50 for receiving the push rods 28, 35 and cams 31, 37. The slot 50 comprises a generally large central section 52 and a pair of opposing sections 54, 56 designed for receiving and engaging the cams 31, 37, respectively, as discussed in operation further below.

Figure 5:
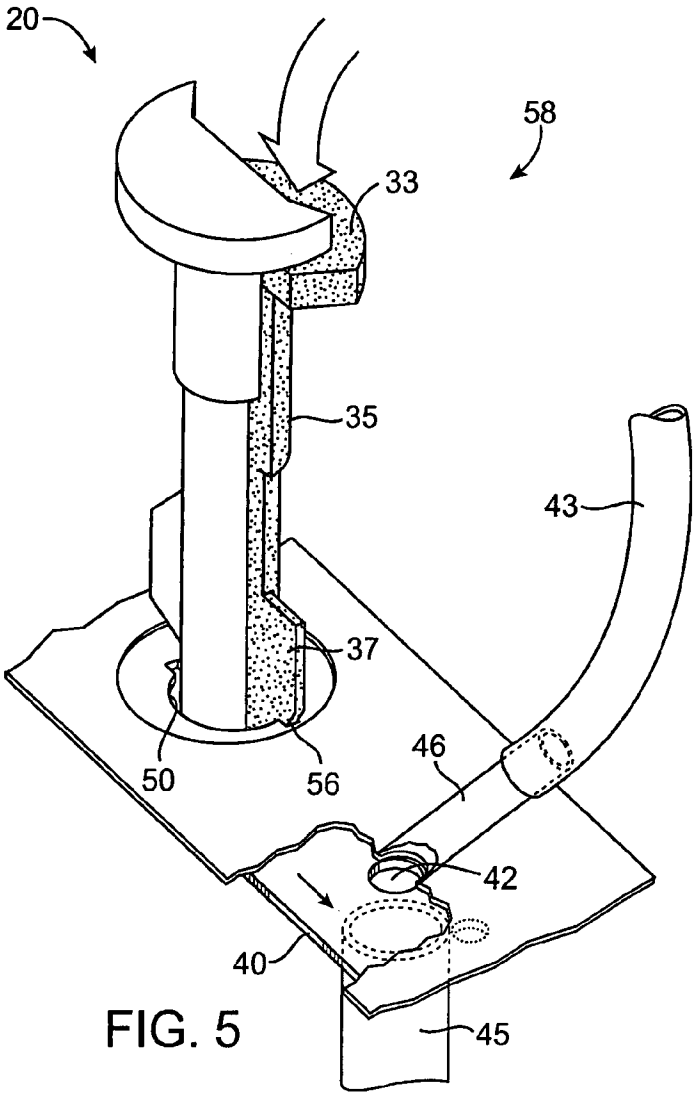
FIG. 5 is a perspective view of a preferred embodiment of the dual flush refill device in a partial flush state.

FIG. 5 illustrates the operation of the refill device 20 in a partial flush state, or position, 58 when the partial flush button 33 is engaged. When a partial flush option is selected by a user, a shorter amount of time is provided for refilling the toilet bowl (not shown). Accordingly, the device 20 refills the toilet bowl to an adequate level in such lesser duration of time by increasing the flow rate of water being delivered from the refill tube to the overflow tube leading to the toilet bowl. In particular, pressing the partial flush button 33 moves the partial flush push rod 35 downward, thereby causing the partial flush cam 37 to move through the slot 50, specifically the partial flush section 56. This causes the slide 40 to move horizontally in a first direction to the partial flush position 58 whereby the large hole 42 is aligned with the refill tube nipple 46. Thus, the large hole 42 is brought into fluid communication with the refill tube 43, thereby creating a large passageway 42 of fluid communication between the refill tube 43 and the overflow tube 45.

As a result, a relatively high flow rate is provided for directing refill water from the refill tube 43 to the overflow tube 45 and ultimately to the toilet bowl. It will be appreciated that when the partial flush option is selected, which limits the duration of time by which the toilet bowl can be refilled, the device 20 adequately compensates for this reduced "refill time" by providing a higher flow rate for directing water from the refill tube to the toilet bowl.

Figure 6:
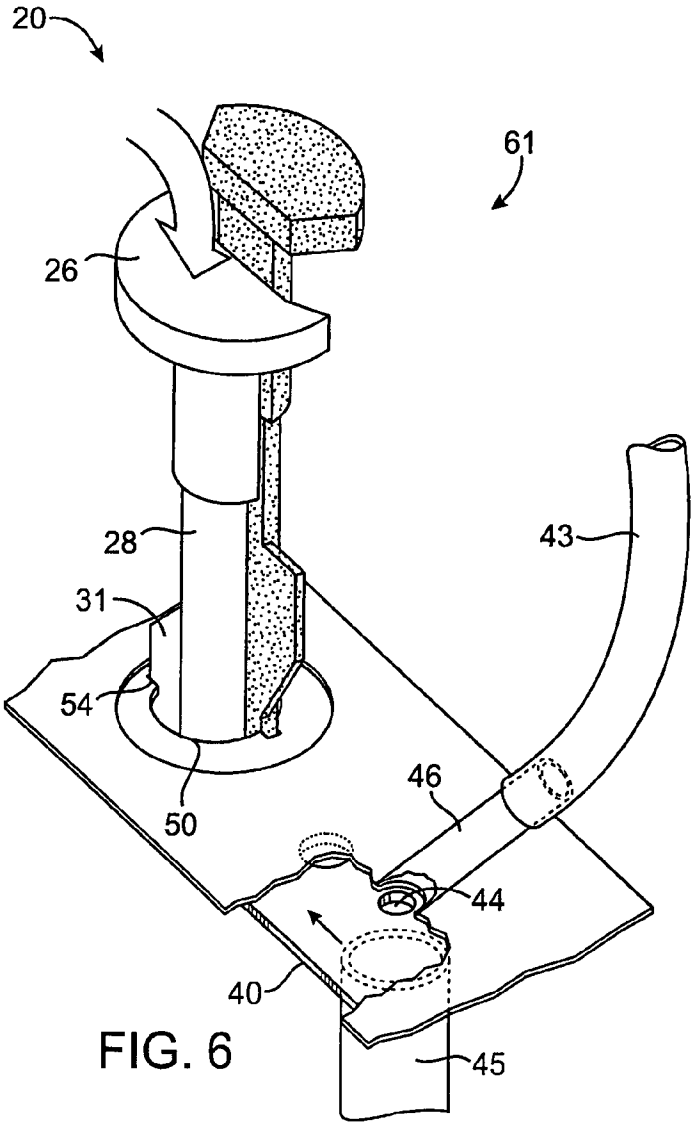
FIG. 6 is a perspective view of a preferred embodiment of the dual flush refill device in a full flush state.

FIG. 6 illustrates the operation of the refill device 20 in a full flush state, or position, 61 when the full flush button 26 is engaged. When a full flush option is selected by a user, a longer amount of time is provided for refilling the toilet bowl (not shown). Accordingly, the device 20 refills the toilet bowl to an adequate level in such greater duration of time without overflowing the bowl or using excessive refill water. This is accomplished by decreasing the flow rate of refill water being delivered from the refill tube to the overflow tube leading to the toilet bowl. In particular, pressing the full flush button 26 moves the full flush push rod 28 downward, thereby causing the full flush cam 31 to move through the slot 50, specifically the full flush section 54. This causes the slide 40 to move horizontally in a second, opposite direction to the full flush position 61 whereby the small hole 44 is aligned with the refill tube nipple 46. Thus, the small hole 44 is brought into fluid communication with the refill tube 43, thereby creating a small passageway 44 of fluid communication between the refill tube 43 and the overflow tube 45.

As a result, a relatively low flow rate is provided for directing refill water from the refill tube to the overflow tube and ultimately to the toilet bowl. It will be appreciated that when the full flush option is selected which extends the duration of time by which the toilet bowl can be refilled, the device 20 adequately compensates for this extended "refill time" by providing a lesser flow rate for directing refill water from the refill tube to the toilet bowl, thereby conserving water while adequately refilling the bowl. Without such restriction in the refill flow rate during a full flush, excessive water will be directed into the bowl and out the drain outlet, thus wasting the clean refill water.

In the preferred embodiment, the slide 40 is thus horizontally movable between two discrete positions 58, 61 as shown in FIGS. 5 and 6, respectively, so as to provide fluid communication between the refill tube and the overflow tube at differing flow rates. Accordingly, each cam 31, 37 comprises an actuator 31, 37 for opening fluid communication between the refill tube and the overflow with differently sized passageways that define differing flow rates depending upon which of the two dual flush options is selected by the user. Therefore, whether a partial flush or full flush is selected by the user, the toilet bowl is refilled with the same volume of refill water each time. Furthermore, this equal volume of refill water being provided with each flush is sufficient for blocking fumes from the drain pipe and for inducing siphonic action in the bowl with the next anticipated flush.

It is to be expressly understood that a variety of different structural mechanisms may be employed to vary the flow rates between the refill tube and the overflow tube. The interaction between the cams 31, 37 and the slide 40 with holes 42, 44 comprise merely one preferred embodiment of alternating flow rates between the refill tube and the overflow tube.

Figure 7:
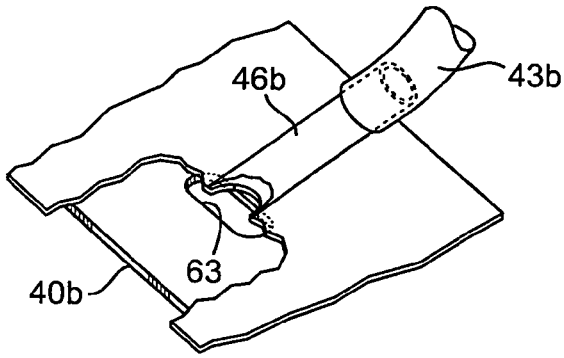
FIG. 7 is a perspective view of a second preferred embodiment of the dual flush refill device in a partial flush state.
Figure 8:
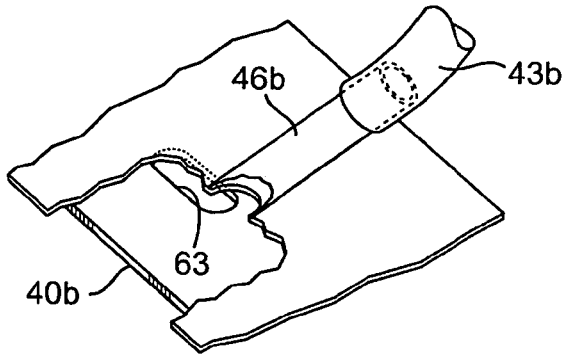
FIG. 8 is a perspective view of the second preferred embodiment of the dual flush refill device in a full flush state.

This is shown in a second preferred embodiment illustrated in FIGS. 7 and 8 where elements of similar structure are designated by the same reference numerals followed by the lower case "b". Here, instead of providing two passageways or holes, a single hole or passageway 63 is defined in the slide 40. In this preferred embodiment, the hole 63 is shaped as an elongate slot such that it can be fully open to the connector 46*b* in the partial flush state, as shown in FIG. 7, or partially open to the connector 46*b* in the full flush state. Thus, the single passageway 63 enables a high flow rate of refill water from the refill tube 43*b* when the passageway 63 is fully open to the connector 46*b*, and a lower flow rate of water from the refill tube 43*b* when the passageway 63 is partially open to the connector 46*b*. In the full flush state shown in FIG. 8, it will be appreciated that portions of the slide surrounding the slot 63 serve to block water flow from the refill tube 43*b*.

Figure 9:
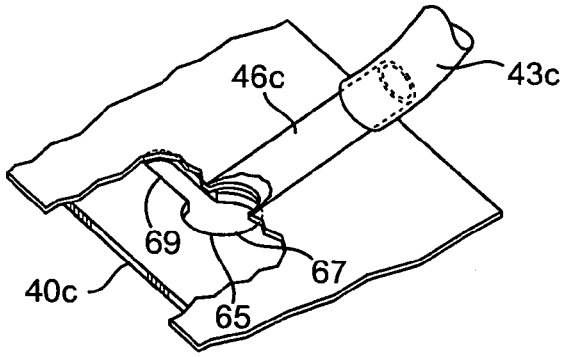
FIG. 9 is a perspective view of a third preferred embodiment of the dual flush refill device in a partial flush state.
Figure 10:
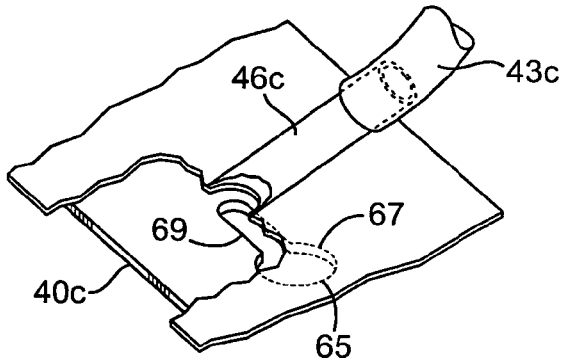
FIG. 10 is a perspective view of the third preferred embodiment of the dual flush refill device in a full flush state.

It will be appreciated that a single passageway formed in a slide may take a number of different configurations to create entirely open fluid communication or partial fluid communication. As a further example, FIGS. 9 and 10 illustrate a third preferred embodiment where elements of similar structure are designated by the same reference numerals followed by the lower case "c". In FIGS. 9 and 10, a single hole or passageway 65 is formed in a slide 40*c* with a large section 67 configured for full fluid communication and a smaller section 69 for partial fluid communication. In the illustrated embodiment, the single passageway 65 comprises a key shape although it is to be expressly understood that the passageway 65 may take several different shapes to accomplish the same purpose of creating full and partial fluid communication. FIG. 9 illustrates the slide 40*c* in the partial flush state with full fluid communication as the large section 67 of the passageway 65 is aligned with the connector 46*c*. FIG. 10 illustrates the slide 40*c* in the full flush state where the small section 69 of the passageway 65 is aligned with the connector 46*c* for providing a lower refill flow rate of water from the refill tube 43*c*.

Figure 12:
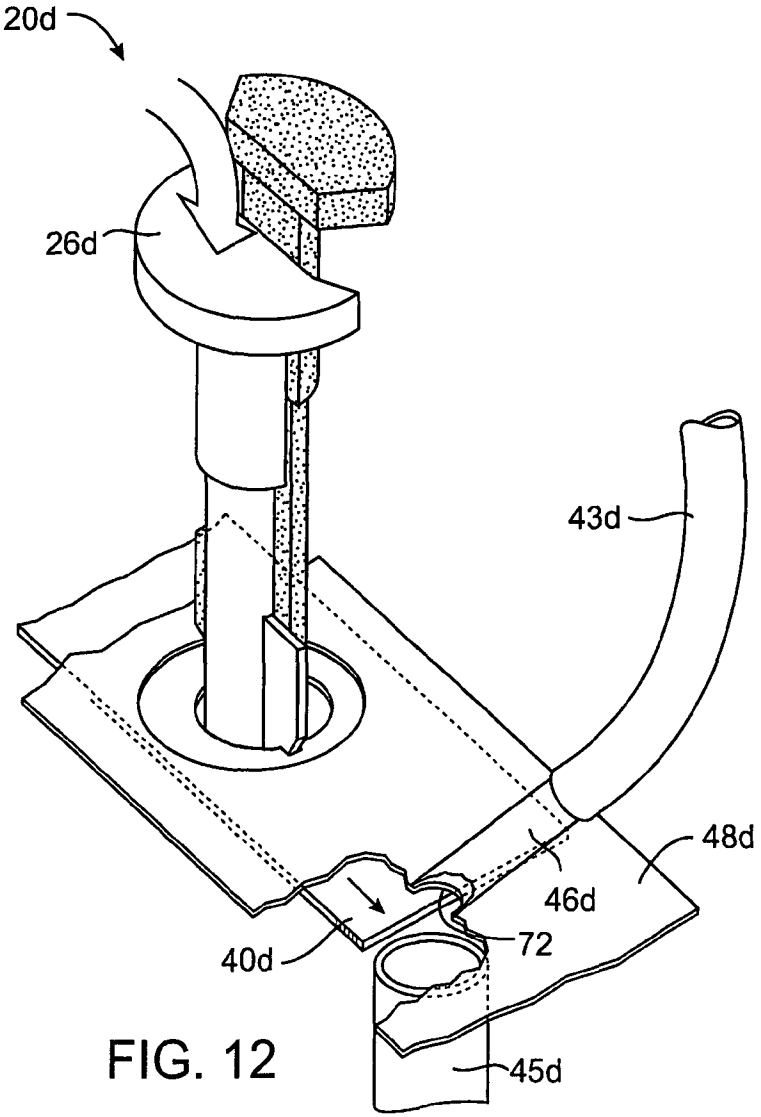
FIG. 12 is a perspective view of the fourth preferred embodiment of the dual flush refill device in a full flush state.
Figure 11:
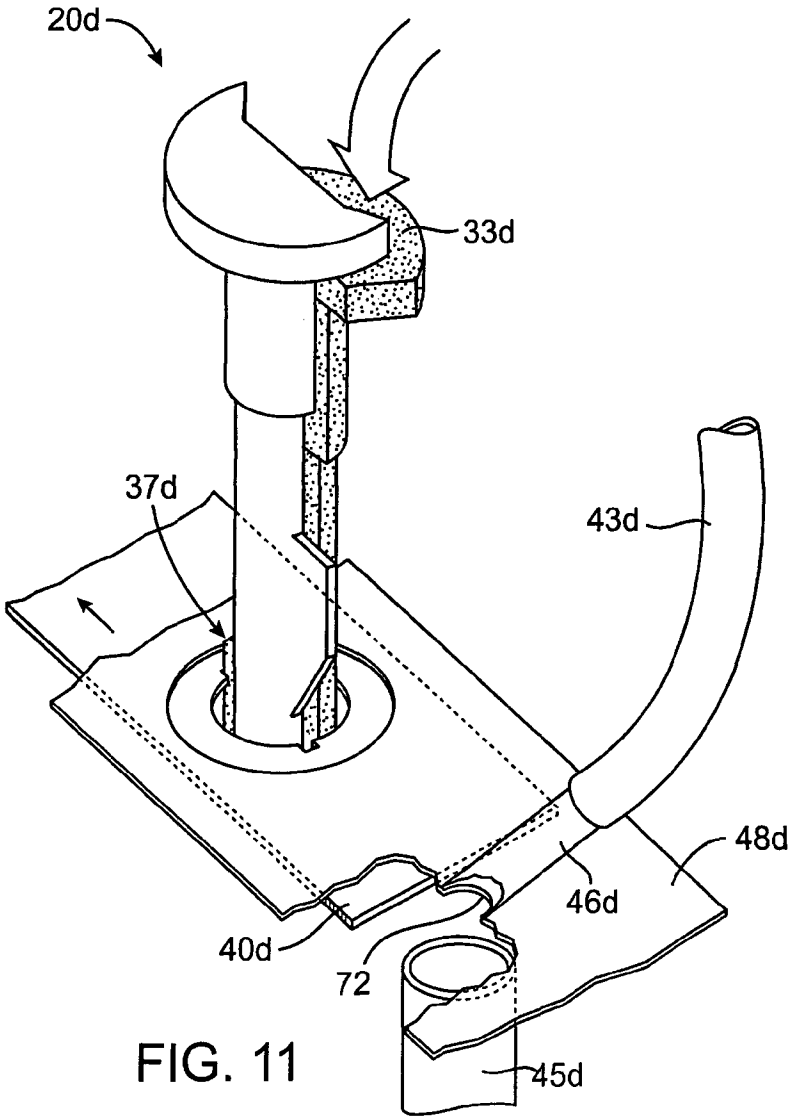
FIG. 11 is a perspective view of a fourth preferred embodiment of the dual flush refill device in a partial flush state.

FIGS. 11 and 12 illustrate a fourth preferred embodiment where elements of similar structure are designated by the same reference numerals followed by the lower case "d". The fourth preferred embodiment 20*d* comprises a slide 40*d* without any holes. Instead of restricting flow with large and small holes, or large and small sections of a single hole, the slide 40*d* is configured to move completely out of the fluid path between the connector 46*d* and the overflow tube 45*d* when the partial flush button 33*d* is engaged as shown in FIG. 11. Accordingly, the placement of the cams in this illustrated embodiment have been reversed with respect to earlier embodiments to accomplish the desired movement of the slide 40*d*. In this partial flush state, the device 20*d* enables a high flow rate as refill water from the refill tube 43*d* flows unrestricted and unobstructed to the overflow tube 45*d*. In particular, refill water flows from the refill tube 43*d* to the connector 46*d* through a hole 72 defined on the button bracket 48*d* that is entirely exposed. In particular, when a partial flush button 33*d* is engaged, a partial flush cam 37*d* moves a slide 40*d* to expose the entirety, or at least a majority portion, of the hole 72. This provides a relatively high refill flow rate which is required for shorter duration of the partial flush.

In a full flush state as shown in FIG. 12 when the full flush button 26*d* is pressed, the slide, or block, 40*d* is moved to partially block, or choke, the hole 72 so as to reduce the flow rate therethrough. This partially closed hole 72 provides a relatively low flow rate for the extended duration of the full flush. Thus, the device 20*d* serves as a valve that alternates the flow rate from the refill tube 43*d* to the overflow tube 45*d* by reducing the size of the hole 72, thereby blocking or diverting water from entering the overflow tube 45*d*.

Figure 13:
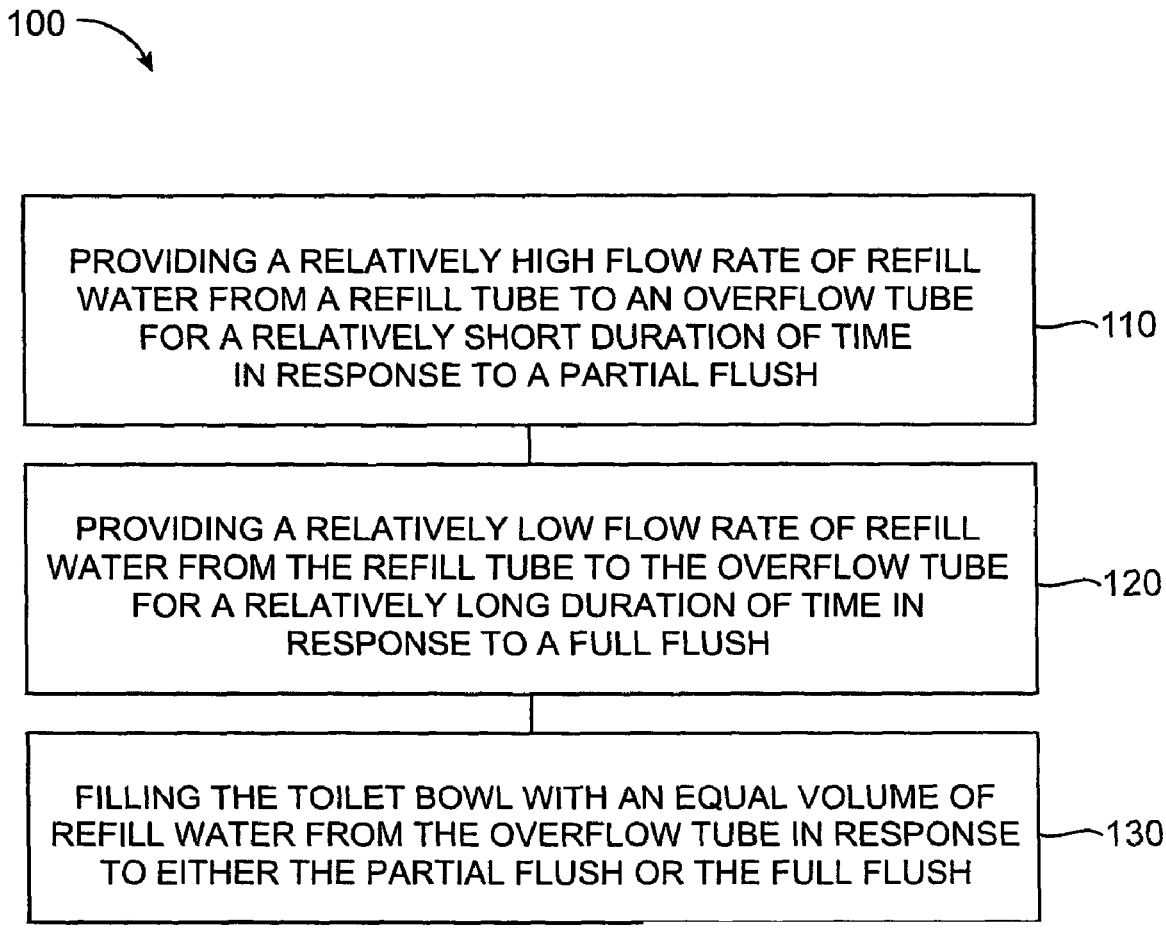
FIG. 13 is a diagram of a preferred method of refilling a bowl of a dual flush toilet.

FIG. 13 illustrates a preferred method 100 for refilling a siphonic bowl of a dual flush toilet. The method 100 comprises a step 110 of providing a relatively high flow of refill water from a refill tube to an overflow tube for a relatively short duration of time in response to a partial flush. This step 110 may comprise aligning the larger one of two holes with a refill tube, or refill tube connector, so as to enable a high flow rate of water to the overflow tube. Alternatively, this step 110 may comprise exposing the entirety or a majority portion of a single hole defined in a slide to a refill tube or a refill tube connector. The step 110 may further comprises opening or blocking water flowing from a refill tube to an overflow tube with a movable slide.

Step 120 includes providing a relatively low flow of refill water from the refill tube to the overflow tube for a relatively long duration of time in response to a full flush. This step 120 may comprise aligning the smaller one of two holes with a refill tube, or refill tube connector, so as to enable a low flow rate of water to the overflow tube. Alternatively, this step 120 may comprise partially blocking, or chocking, a single hole that is open to a refill tube or a refill tube connector.

Step 130 comprises filling the toilet bowl with an equal volume of water from the overflow tube in response to either the partial flush or the full flush. Thus, no matter which of the dual flush options is chosen, the toilet bowl will be filled with the same volume of water for an adequate refill while still conserving water.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different elements, which are disclosed in above even when not initially claimed in such combinations.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what incorporates the essential idea of the invention.

What is claimed is:

1. A method for refilling a bowl of a dual flush toilet, comprising:

establishing a higher flow rate of water from a refill tube to an overflow tube in a toilet tank for a shorter duration of time in response to a partial flush by aligning a first hole in a slide with a refill tube connector, the first hole defining a first area; or establishing a lower flow rate of water from a refill tube to an overflow tube in a toilet tank for a longer duration of time in response to a full flush by aligning a second hole in a slide with a refill tube connector, the second hole defining a second area smaller than the first area; such that the toilet bowl is filled using the same volume of water from the overflow tube in response to either the partial flush or the full flush, wherein refilling water is delivered from the refill tube into the overflow tube leading into the bowl, and wherein the bowl and the tank refill at the same time such that a shorter amount of time is provided for refilling the bowl after a partial flush and a longer amount of time is provided for refilling the toilet bowl after a full flush.

2. The method of claim 1, wherein:

aligning the first hole with the refill tube connector comprises moving the first hole with a first cam; and aligning the second hole with a refill tube connector comprises moving the second hole with a second cam.

3. A method for refilling a bowl of a dual flush toilet, comprising:

directing a higher flow of water for a shorter period of time from a refill tube to an overflow tube in a toilet tank through a first opening in a slide between the refill tube and the overflow tube in response to a partial flush, the first opening having a first area; or directing a lower flow of water for a longer period of time from a refill tube to the overflow tube in a toilet tank through a second opening in a slide between the refill tube and the overflow tube in response to a full flush, the second opening having a second area smaller than the first area; such that the toilet bowl is filled with the same volume of water from the overflow tube in response to either the partial flush or the full flush, wherein refilling water is delivered from the refill tube into the overflow tube leading into the bowl, and wherein the bowl and the tank refill at the same time such that a shorter amount of time is provided for refilling the bowl after a partial flush and a longer amount of time is provided for refilling the toilet bowl after a full flush.

4. The method of claim 3, wherein the first opening is separate from the second opening, the method further comprising:

aligning the first opening with a refill tube connector to direct water through the first opening; or aligning the second opening with a refill tube connector to direct water through the second opening.

5. The method of claim 4, wherein:

aligning the first opening with the refill tube connector comprises moving the first opening with a first cam; or aligning the second opening with the refill tube connector comprises moving the second opening with a second cam.

6. A method for refilling a bowl of a dual flush toilet, comprising:

providing a bracket having a refill tube connector with an outlet passageway and a slide movable with respect to the bracket so as to partially block and unblock the passageway;

directing water from a refill tube to an overflow tube in a toilet tank for a shorter duration of time in response to a partial flush by moving the slide away from the passageway between the refill tube and the overflow tube so that the slide does not block the passageway; or reducing a flow rate of water from a refill tube to an overflow tube in a toilet tank for a longer duration of time in response to a full flush by moving the slide to partially block a portion of the passageway between the refill tube and the overflow tube, wherein the flow rate of water is reduced from a higher flow rate of water to a lower flow rate of water for the second duration of time, the second duration of time being longer than the first duration of time; and thereby filling the toilet bowl with the same volume of water from the overflow tube in response to either the partial flush or the full flush, wherein refilling water is delivered from the refill tube into the overflow tube leading into the bowl, and wherein the bowl and the tank refill at the same time such that a shorter amount of time is provided for refilling the bowl after a partial flush and a longer amount of time is provided for refilling the toilet bowl after a full flush.

* * * * *